United States Patent [19]

Matsui et al.

[11] Patent Number: 4,916,853

[45] Date of Patent: Apr. 17, 1990

[54] METHOD FOR MANUFACTURING WELDED PIPES

[76] Inventors: Shigetomo Matsui, 4-25, Higashiyama-Cho, Higashiosaka-Shi, Osaka-Fu; Hisao Hasegawa, 13-24, Nishiokamoto 2-Chome, Higashinada-Ku, Kobe-Shi, Hyogo-Ken, both of Japan

[21] Appl. No.: 68,183

[22] Filed: Jun. 30, 1987

Related U.S. Application Data

[63] Continuation of Ser. No. 754,202, Jul. 11, 1985, Pat. No. 4,717,065, which is a continuation of Ser. No. 498,596, May 26, 1983, abandoned.

[51] Int. Cl.[4] ..... B23K 31/06

[52] U.S. Cl. ..... 228/147

[58] Field of Search ..... 228/146, 147, 129, 130, 228/144, 173 F; 72/368, 52; 29/148, DIG. 21, DIG. 24

[56] References Cited

U.S. PATENT DOCUMENTS

| | | | |
|---|---|---|---|
| 1,960,523 | 5/1934 | Anderson | 228/147 |
| 2,666,831 | 1/1954 | Seulen et al. . | |
| 2,673,274 | 3/1954 | Vaughan et al. . | |
| 2,977,914 | 4/1961 | Gray et al. | 228/147 |
| 3,127,674 | 4/1964 | Kohler | 228/147 |
| 4,460,118 | 7/1984 | Ataka | 228/146 |

FOREIGN PATENT DOCUMENTS

| | | | |
|---|---|---|---|
| 0158979 | 10/1985 | European Pat. Off. | 228/147 |
| 43-14092 | 2/1968 | Japan | 228/147 |
| 1292471 | 4/1969 | Japan | 228/147 |
| 0050715 | 5/1981 | Japan | 228/147 |
| 0102313 | 8/1981 | Japan | 228/147 |

*Primary Examiner*—Kurt Rowan

[57] ABSTRACT

In the manufacture of welded pipes, edge buckling or waving of the strip is prevented by heating. In one method, during the process for bending the strip into a tubular form, the edges of the strip are heated so that tensile stress exerted thereon is reduced to a minimum and, thereafter, before the edges are abutted against each other, the strip is wholly heated so that the compressive stress exerted on the edges is reduced to a minimum. According to another mode, during the process for bending the strip gradually into a tubular form or during the process in which the edges of the strip are held in abutment against each other, the strip except its portions of the edges is substantially or partially heated so that the strip except its portions of the edges is subjected to compressive stress while the portions of the edges are subjected to tensile stress, and under these conditions the edges are welded together.

7 Claims, 4 Drawing Sheets

METHOD FOR MANUFACTURING WELDED PIPES

This is a continuation of Ser. No. 06/754,202 filed on July 11, 1985 now U.S. Pat. No. 4,717,065 which was, a continuation of Ser. No. 06/498,596 filed on May 26, 1983, now abandoned.

BACKGROUND OF THE INVENTION

The present invention relates generally to a method for the manufacture of welded pipes and, more particularly, to a method for preventing buckling or waving of edges of the strip in the manufacture of thin-walled welded tubular products.

Various types and kinds of pipes are used for various purposes. Among such pipes welded pipes are widely used because they can be fabricated in a relatively simple manner at low cost.

In the production of a welded pipe, the strip which is wound in the form of a coil is unwound and fed in an unheated condition through shaping rolls which gradually bring together the two longitudinal edges of the strip to bend the same into a tubular form circular in cross section, and finally the longitudinal edges of the strip are welded together. When the unheated strip is being bent, the longitudinal edges of the strip are subjected to tensile stress in the longitudinal direction and plastically deformed. However, when the edges are abutted against each other, the strip except its edge portions is subjected to tensile stress while the edge portions are subjected to compressive stress due to the plastic strain at the edge portion during the bending process. As a result, during the welding process, the edges are subject to buckling or waving along the weld line. In the case of thick-walled pipes, such buckling or edge waving hardly occurs, but in the case of thin-walled pipes, it frequently occurs. Therefore, it has been difficult to manufacture thin-walled welded pipes.

SUMMARY OF THE INVENTION

The present invention seeks to overcome the above and other problems encountered in the manufacture of thin-walled welded pipes. An object of the invention is to provide a method for the manufacture of welded pipes in which the strip is heated in such a manner that during the process of bonding the strip, tensile stress exerted on the edge portions thereof can be reduced to a minimum, and after the edges have been abutted against each other, the compressive stress exerted on the edge portions also can be reduced to a minimum, whereby thin-walled welded pipes which have hitherto been difficult to manufacture can be manufactured without difficulty.

According to an aspect of the present invention, during the process for bending the strip into a tubular form, only the longitudinal edge portions of the strip are heated so that tensile stresses exerted thereto will be reduced to a minimum, and after the edges have been abutted against each other, that is, after the strip has been bent into a tubular form substantially circular in cross section, substantially the whole strip is also heated so that the tensile stress exerted on the portion of the strip except its edge portions will be reduced to a minimum while the compressive stress exerted on the edges will be also reduced to a minimum, whereby the buckling of the edges is prevented. Therefore, thin-walled welded pipes have hitherto been difficult to produce can be fabricated without difficulty.

According to another aspect of the present invention, during the process for bending the strip gradually into a tubular form or during the process in which the edges of the strip are held in abutment against each other, the strip is substantially or partially heated, except at its edge portions, so that the strip is subjected to compressive stress while the edge portions are subjected to tensile stress. Therefore, the abutted edges are not subjected to compressive stress before they are welded together. As a result, the buckling of the edges can be prevented, and consequently the so-called edge waving can be avoided. Thus it becomes possible to manufacture thin-walled welded pipes without difficulty.

The residual tensile stress due to the welding along the weld line usually reaches almost the yield strength of the strip. But according to this mode of the invention, the tensile stress exerted on the edge portions due to the temperature distribution before welding is reduced after the welded pipe has been cooled to room temperature. As a result, residual tensile stress is substantially reduced to a minimum after the welded pipe is cooled to room temperature. Therefore, stress corrosion cracking or the like can be prevented.

Thus, according to the present invention, various kinds and types of welded pipes can be fabricated without difficulty.

The above and other objects, effects and features of the present invention will become more apparent from the following description of preferred embodiments thereof taken in conjunction with the accompanying drawings.

DETAILED DESCRIPTION OF THE INVENTION

Figure 1:
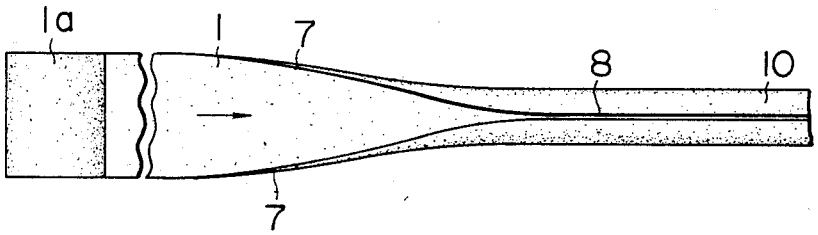
FIGS. 1 and 2 are views explanatory of the basic principal of the method for the manufacture of tubular products.
Figure 2:
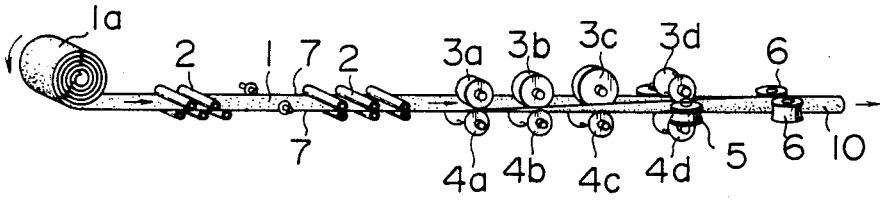

Referring first to FIGS. 1 and 2, a strip of steel 1 is previously wound in the form of a coil 1*a*. The strip 1 is unwound from the coil 1*a* through a plurality of rollers 2 and then the unheated strip is fed through conventional shaping rolls 3*a*, 4*a*, 3*b*, 4*b*, 3*c*, 4*c*, 3*d*, 4*d*, and 5 which gradually bend the strip 1 into a tubular shape, its longitudinal or side edges 7 being gradually bent toward, and finally abutted against, each other by a pair of shaping rollers or pressure rollers 6 as indicated by 8 in FIG. 1. Thus, the strip 1 is formed into a tubular section 10 circular in cross section. Thereafter, the abutting edges 8 are welded in the longitudinal direction as will be described hereinafter.

Figure 3:
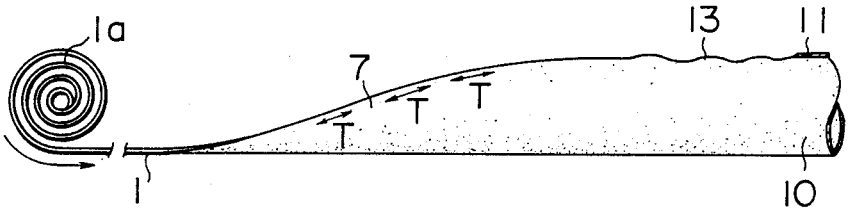
FIG. 3 is a view, in side elevation, showing how tensile stress is exerted on the edge portions of the unheated strip, resulting in edge buckling or waving thereof.

During the process in which the unheated strip 1 is bent into the form of the tubular section 10; that is, during the process in which the side edges 7 are bent or drawn toward each other, a longitudinal tensile stress T in excess of the elastic limit of the unheated strip 1 is exerted on the side edges 7 as shown in FIG. 3 so that the edges 7 are subjected to plastic deformation. At the end of the bending process when the edges 7 are abutted against each other as shown at 8, tensile stress is exerted on the tubular section 10. However, the edges 7 which have been subjected to the plastic deformation are subjected to compressive stress because even after the edges 7 have been abutted against each other to settle in a state parallel with the axis of the tubular section 10, they cannot return fully to the condition prior to being subjected to the tensile plastic deformation.

As a result, as shown in FIG. 3, before the abutted edges 8 are welded together, the edges 7 buckle mainly in the region between the shaping roll **3*d* and the welding position 11, so that edge waving 13 occurs. In the case of pipes with relatively thick walls, almost no edge waving 13 occurs, but in the case of pipes with relatively thin walls, edge waving 13 frequently occurs so that the welding of the abutted edges 8** becomes very difficult. For instance, when the ratio t/D, where t is the thickness of the strip and D is the diameter of the pipe, is less than 0.02, it becomes impossible to manufacture tubular products.

Figure 4:
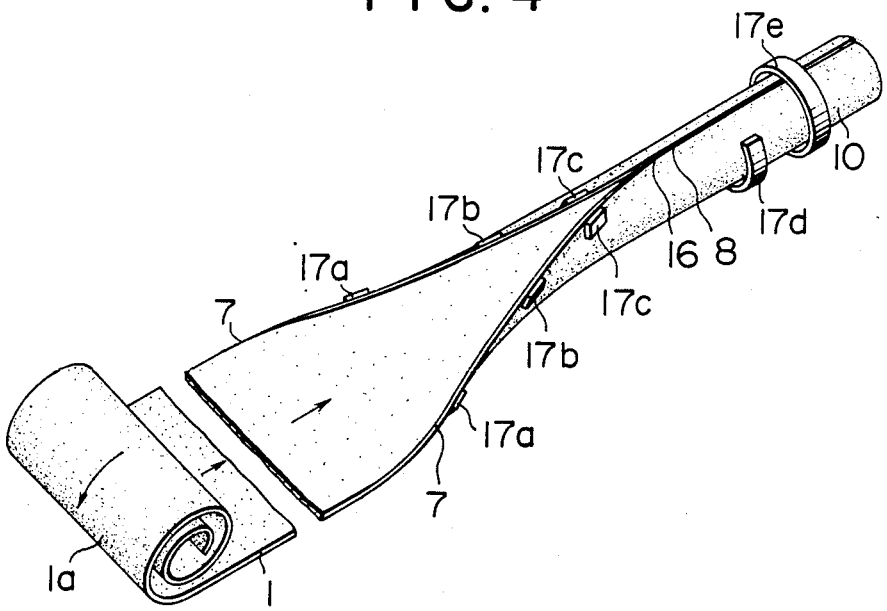
FIG. 4 is a schematic perspective view showing a first form of the present invention.
Figure 5:
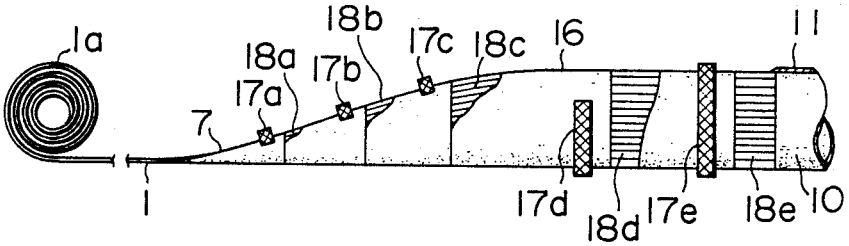
FIG. 5 is a view, in side elevation, showing primarily temperature distributions in the skelp when heated by heating devices.

Referring next to FIGS. 4 and 5, according to the present invention, a suitable number of heating devices **17*a*, 17*b* and 17*c*, such as high-frequency induction heaters, are disposed between the shaping rolls in opposed realtionship with the edges 7 of the strip 1 in the region where tensile stress is exerted on the edges. Therefore, the unheated strip 1 is fed to and then through the shaping rolls and the edges 7 are heated as the strip is being advanced while being bent, and temperature distributions as indicated by 18*a*, 18*b* and 18*c* are established adjacent to the edges 7. As a result, the tensile stress exerted on the edges 7 is reduced, whereby the edges 7 become free from plastic deformation. In FIG. 5, the horizontal extents of the areas 18*a*, 18*b* and 18*c* indicating the temperature distributions represent the values of temperature. It is seen that the heated areas are gradually expanded from the edges 7 as the edges 7 pass through the heating devices 17*a*, 17*b* and 17*c* and the temperature of the edges 7 gradually increases. Adjacent to the edge abutting point 16 where the edges 7 start to abut against each other, there is disposed a heating device 17*d*, such as a high-frequency induction heater, which surrounds from below the tubular section 10 about two thirds of its circumference so that a heated area 18*d* having the temperature distribution as shown is produced, and consequently the tensile stress exerted on the cylindrical portion between the edges 7 is reduced. As a consequence, the compressive stress exerted on the edges 7** can be further reduced.

A ring-shaped heating device **17*e*, such as a high-frequency induction heater, which encircles the tubular section 10 is disposed immediately before be position 11 where the welding of the opposed edges 8 is started, whereby the tubular section 10 is uniformly heated as indicated by 18*e*. As a result, buckling of the edges 7** can be prevented.

When the welded tubular section 10 is cooled to room temperature, the welded seam is smooth. That is, even in the case of thin-wall pipes, no edge waving will occur.

It is to be understood that the present invention is not limited to the specific example described above. For instance, instead of the high-frequency heat induction devices, any other suitable heating means such electric strip heaters may be used. Furthermore, the present invention may be applied equally to the manufacture of thickwalled tubular products.

As described above, according to the first form of the invention, the side edges of the strip are heated when they are subjected to tensile stresses during the process of bending the skelp into a tubular form. As a result, the plastic deformation of the edges can be reduced to a minimum.

Furthermore, the entire strip is heated during the process stage in which the edges start to abut against each other and in which the tensile stress is exerted on the portions other than the edge portions while the edge portions are subjected to compressive stress, so that the tubular section is uniformly heated. As a consequence, not only the tensile stress but also the compressive stress can be reduced so that no edge waving occurs along the side edges.

Figure 6:
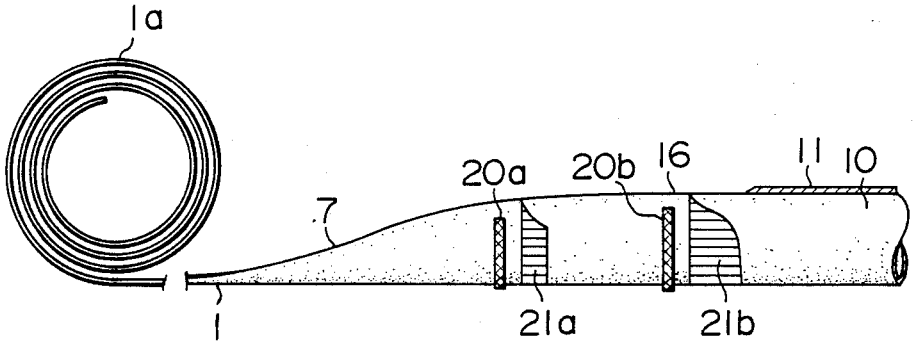
FIG. 6 is a view, in side elevation, showing a second form of the present invention.
Figure 7:
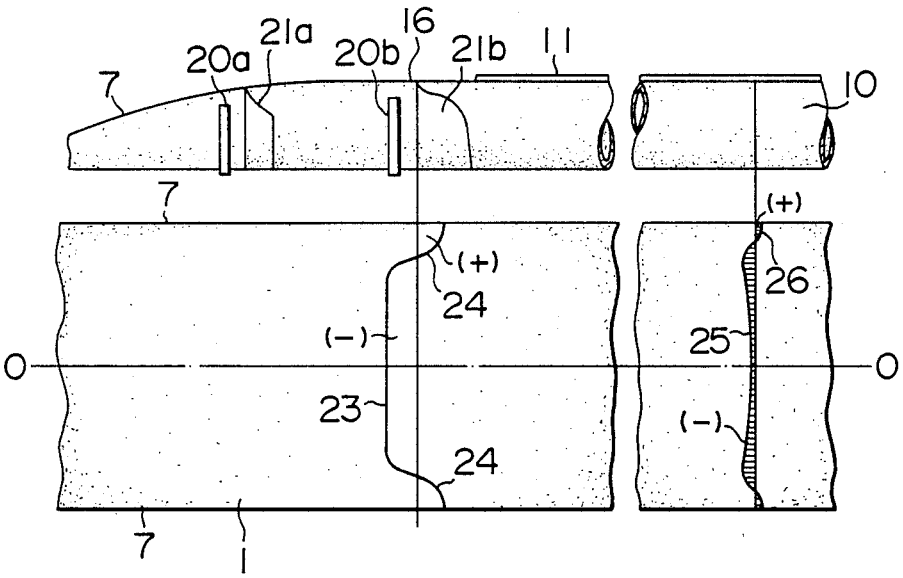
FIG. 7 is a view explanatory of stress distributions in the strip and the welded pipe after being cooled to room temperature, according to the method of FIG. 6.

According to a second form of the present invention, as illustrated in FIGS. 6 and 7, a suitable number (two in the illustrated example) of heating devices **20*a* and 20*b*, such as high-frequency heaters, are disposed between the shaping rolls so as to surround the strip 1 being bent except the portions of its edges 7. That is, the heating devices 20*a* and 20*b* are in the form of an arc and temperature distributions 21*a* and 21*b*** are obtained.

During the bending process the edges 7 of the unheated strip are subjected to tensile stress as mentioned hereinbefore with reference of FIG. 3. Because of the temperature distributions **21*a* and 21*b* after passing through the heating devices 20*a* and 20*b*, respectively, the main portion of the strip 1 except the portions of the edges 7 is subjected to compressive stress, and consequently the edges 7 are subjected to tensile stress at the edge abutting position 16**.

If the induction heating devices **20*a* and 20*b* were not provided, the main portion of the strip 1 except the portions of the edges 7 would be subjected to tensile stress while the edges 7 would be subjected to compressive stress so that the edges 7 would be subjected to buckling or waving. However, according to this method, as shown in FIG. 7 illustrating the development of the strip 1 with its centerline indicated by O–O, the main portion of the strip 1 except the portions of the edges 7 is subjected to compression (−) as indicated by 23 at the edge abutting position 16 while the portions of the edges 7 are subjected to tension (+) as indicated by 24. As a result, the edges 7** are prevented from buckling.

When the edges 7 without waving are welded as indicated by 11, they are subjected to residual tensile stress due to the welding. If the strip 1 were not heated in the manner described above, the residual stress would exceed the yield point of the strip 1, but, according to this method, when the welded pipe is cooled to room temperature, the residual tensile stress is considerably decreased as indicated by 25 and 26 in FIG. 7 so that the welded pipe is amply free of stress corrosion cracking.

The thus welded pipe is free from buckling or waving and the residual stresses are considerably minimized. The welded pipe has clean and smooth surfaces.

Figure 8:
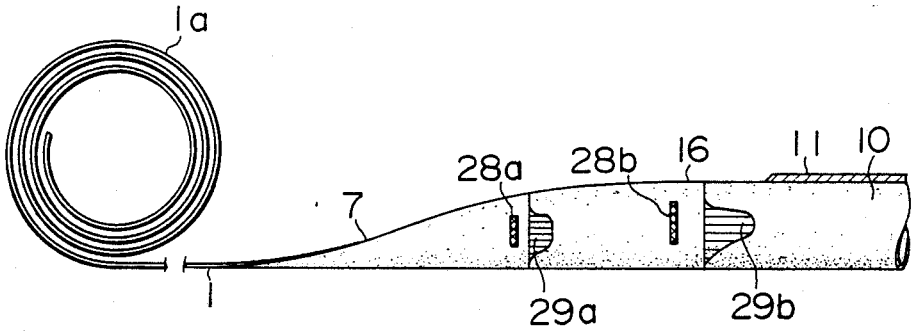
FIG. 8 is a view, in side elevation, showing a modification of the second form of the present invention.
Figure 9:
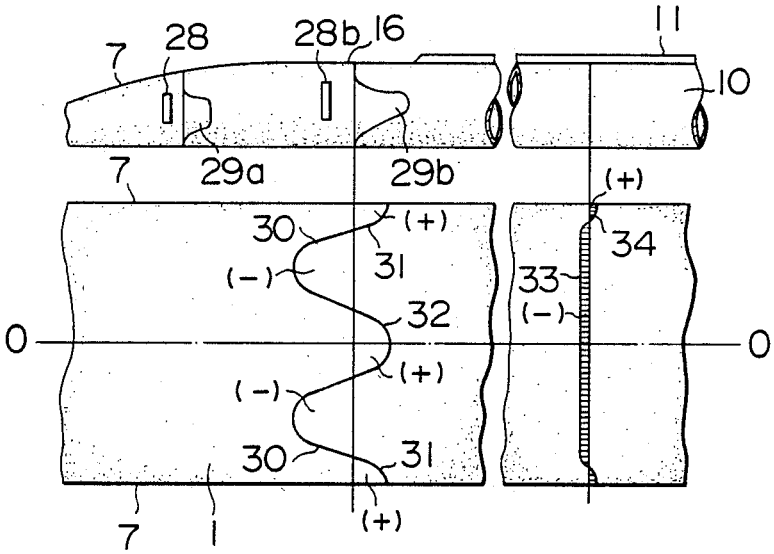
FIG. 9 is a view explanatory of stress distributions in the strip and the welded pipe after being cooled to room temperature, according to the method of FIG. 8.

A modified method shown in FIGS. 8 and 9 is substantially similar to the modes as shown in FIGS. 6 and 7 except that two heating devices 28*a* and 28*b* are so disposed as to heat only portions of the strip 1 in the circumferential direction thereof. Therefore, the strip 1 is heated as indicated by 29*a* and 29*b* so that, as shown in FIG. 9, at the edge abutting position 16, the portions of the edges 7 and the center or bottom portion are subjected to tension (+) as indicated by 31 and 32, respectively, while the portions therebetween are subjected to compression (−) as indicated by 30. Therefore, when the welded pipe is cooled to room temperature, the residual stresses are considerably reduced as indicated by 33 and 34.

We claim:

1. In a method for the manufacture of welded pipes in which a strip having a flat shape is fed through shaping rolls which gradually bring together the longitudinal edges of the strip in opposed abutting relation to bend the same into tubular form, and then the thus opposed edges of the bent tubular section are welded together, the improvement comprising preventing buckling or waving of said longitudinal edges by the steps of:

during the process during which said strip has begun to be bent from its flat shape into tubular form, reducing tensile stress exerted on regions of said strip adjacent said longitudinal edges which are being brought together gradually by heating said regions while maintaining the middle part of said strip between said regions substantially free of such heating; and after said longitudinal edges have been abutted against each other and until immediately before said edges are welded together, reducing the compressive stress exerted on said longitudinal edges by heating said strip around substantially the entire circumference thereof.

2. The improvement claimed in claim 1, comprising heating the entire circumference of said strip by means of heating means disposed to extend at least partly around the tubular section to be formed.

3. In a method for the manufacture of welded pipes in which a strip is fed through shaping rolls which gradually bring together the longitudinal edges of the strip in opposed abutting relation to bend the same into tubular form, and then the thus opposed edges of the bent tubular section are welded together, the improvement comprising preventing buckling or waving of said longitudinal edges by the steps of:

during the process of bending said strip into tubular form, reducing tensile stress exerted on said longitudinal edges by heating said longitudinal edges by means of a plurality of heating means disposed successively along the paths of said longitudinal edges at locations between longitudinally adjacent said shaping rolls, while maintaining the middle part of said strip between said longitudinal edges substantially free of such heating; and after said longitudinal edges have been abutted against each other and until immediately before said edges are welded together, reducing the compressive stress exerted on said longitudinal edges by heating said strip around substantially the entire circumference thereof.

4. In a method for the manufacture of welded pipes in which an unheated strip having a flat shape is fed to and then through shaping rolls which gradually bring together the longitudinal edges of the strip in opposed abutting relation to bend the same into tubular form, and then he thus opposed edges of the bent tubular section are welded together, the improvement comprising preventing buckling or waving of said longitudinal edges by the steps of: during the process during which said unheateed strip has begun to be bent from its flat shape into tubular form, reducing tensile stress exerted on regions of said strip adacent said longitudinal edges which are being brought together gradually by heating only said regions while maintaining the middle part of said strip between said reegions substantially free of such heating; and after said longitudinal edges have been abutted against each other and until immediately before said edges are welded together, reducing the compressive stress exerted on said longitudinal edges by heating said strip around substantially the entire circumference thereof.

5. The improvement claimed in claim 4, comprising heating the entire circumference of said strip by means of heating means disposed to extend at least partly around the tubular section to be formed.

6. In a method for the manufacture of welded pipes in which an unheated strip is fed to and then through shaping rolls which gradually bring together the longitudinal edges of the strip in opposed abutting relation to bend the same into tubular form, and then the thus opposed edges of the bent tubular section are welded together, the improvement comprising preventing buckling or waving of said longitudinal edges by the steps of:

during the process of feeding the unheated strip into said shaping rolls and bending said strip into tubular form, reducing tensile stress exerted on said longitudinal edges by heating only said longitudinal edges by means of a plurality of heating means disposed successively along the paths of said longitudinal edges at locations between longitudinally adjacent said shaping rolls, while maintaining the middle part of said strip between said longitudinal edges substanially free of such heating; and after said longitudinal edges have been abutted against each other and until immediately before said edges are welded together, reducing the compressive stress exerted on said longitudinal edges by heating said strip around substantially the entire circumference thereof.

7. In a method for the manufacture of welded pipes in which a strip having a flat shape is fed through shaping rolls which gradually bring together the longitudinal edges of the strip in opposed abutting relation to bend the same into tubular form, and then the thus opposed edges of the bent tubular section are welded together, and in which the ratio of the thickness of the strip to the diameter of the pipes is less than 0.02, the improvement comprising preventing buckling or waving of said longitudinal edges by the steps of:

during the process during which said strip has begun to be bent from its flat shape into tubular form, reducing tensile stress exerted on regions of said strip adjacent said longitudinal edges which are being brought together gradually by heating said regions while maintaining the middle part of said strip between said regions substantially free of such heating; and after said longitudinal edges have been abutted against each other and until immediately before said edges are welded together, reducing the compressive stress exerted on said longitudinal edges by heating said strip around substantially the entire circumference thereof.

* * * * *